US007926658B2

(12) United States Patent
Schein et al.

(10) Patent No.: US 7,926,658 B2
(45) Date of Patent: Apr. 19, 2011

(54) BLISTER PACKAGE HAVING SECUREMENT MECHANISM AND METHOD OF FORMING AND FILLING THE BLISTER PACKAGE

(75) Inventors: Thomas P. Schein, Appleton, WI (US); Brent J. Grinwald, Appleton, WI (US)

(73) Assignee: All About Packaging Inc., Appleton, WI (US)

( * ) Notice: Subject to any disclaimer, the term of this patent is extended or adjusted under 35 U.S.C. 154(b) by 0 days.

(21) Appl. No.: 12/660,374

(22) Filed: Feb. 25, 2010

(65) Prior Publication Data

US 2010/0155285 A1 Jun. 24, 2010

Related U.S. Application Data

(63) Continuation-in-part of application No. 12/283,397, filed on Sep. 10, 2008, now abandoned.

(51) Int. Cl.
*B65D 73/00* (2006.01)
*B65B 61/18* (2006.01)

(52) U.S. Cl. ..... 206/468; 53/412; 53/423; 206/470

(58) Field of Classification Search ..... 206/461, 206/467, 468, 470, 806; 53/412, 423
See application file for complete search history.

(56) References Cited

U.S. PATENT DOCUMENTS

| | | | | |
|---|---|---|---|---|
| 2,975,889 | A * | 3/1961 | Brown | 206/468 |
| 3,382,972 | A * | 5/1968 | Phipps | 206/468 |
| 3,621,989 | A * | 11/1971 | Pregont | 206/468 |
| 4,319,684 | A | 3/1982 | Backman et al. | |
| 4,512,474 | A | 4/1985 | Harding | |
| 4,739,883 | A | 4/1988 | Mohs et al. | |
| 5,090,570 | A | 2/1992 | Todd | |
| 5,293,997 | A | 3/1994 | Hustad et al. | |
| 5,593,036 | A | 1/1997 | Dyble et al. | |
| 5,819,939 | A | 10/1998 | Boyer | |
| 5,875,893 | A | 3/1999 | Lee et al. | |
| 5,988,429 | A | 11/1999 | Coe | |
| 6,065,589 | A | 5/2000 | Ouwnes | |
| 6,170,663 | B1 | 1/2001 | Glassman | |
| 6,330,945 | B1 | 12/2001 | Reimer | |
| 6,523,689 | B2 * | 2/2003 | Mickel | 206/468 |

OTHER PUBLICATIONS

Photocopies of packaging by Bernard, 4 pages.
All About Packaging, Inc., Packaging, 3 pages, Associated with Applicant's U.S. Appl. No. 60/625,674.

(Continued)

*Primary Examiner* — Bryon P Gehman
(74) *Attorney, Agent, or Firm* — Thomas J. Connelly; Wilhelm Law, S.C.

(57) ABSTRACT

A blister package and a method of forming and filling the blister package are disclosed. The blister package includes a first member having a three-dimensional bubble, a peripheral flange having a major portion and a minor portion, and at least one area bounded by a perforation line which is capable of being broken. The major portion is folded to create at least one channel and the minor portion has a hook hole formed therethrough. A securement mechanism is formed with the minor portion. The securement mechanism includes a hinged tab and first and second cooperating attachment members. The blister package further includes a second member sized and configured to be slideably received within the at least one channel when the securement mechanism is in an open position. The second member is retained within the at least one channel when the securement mechanism is in a closed position.

22 Claims, 6 Drawing Sheets

OTHER PUBLICATIONS

All About Packaging, Inc., From Concept to Completion . . . All From Once Company, Booklet, 4 pages, Booklet displaying other blister packages made by applicant.

PMC Group, Inc. Company, Advanced Rigid Plastic Films, Booklet, 6 pages.

PACUR, Information Sheet, 1 page.

* cited by examiner

A METHOD OF FORMING A BLISTER PACKAGE HAVING A SECUREMENT MECHANISM, SAID METHOD COMPRISING THE STEPS OF:

FORMING A FIRST MEMBER FROM A TRANSPARENT SHEET OF PLASTIC MATERIAL, SAID FIRST MEMBER HAVING A FRONT SURFACE, A BACK SURFACE, AND A THREE-DIMENSIONAL BUBBLE SURROUNDED BY A PERIPHERAL FLANGE HAVING A MAJOR PORTION AND A MINOR PORTION, SAID MINOR PORTION HAVING AT LEAST ONE AREA BOUNDED BY A PERFORATION LINE WHICH IS CAPABLE OF BEING BROKEN TO SEPARATE SAID BOUNDED AREA FROM SAID FIRST MEMBER, SAID BUBBLE BEING FORMED BETWEEN SAID FRONT AND BACK SURFACES AND BEING CAPABLE OF AT LEAST PARTIALLY RETAINING A PRODUCT, AND INTEGRALLY FORMING A SECUREMENT MECHANISM ON SAID MINOR PORTION OF SAID PERIPHERAL FLANGE, SAID SECUREMENT MECHANISM INCLUDING A FIRST ATTACHMENT MEMBER FORMED ON SAID MINOR PORTION OF SAID PERIPHERAL FLANGE, A TAB EXTENDING OUTWARDLY FROM SAID MINOR PORTION OF SAID PERIPHERAL FLANGE AND HAVING A HINGE FORMED THEREIN, AND A SECOND ATTACHMENT MEMBER FORMED IN SAID TAB OUTWARD OF SAID HINGE, SAID SECOND ATTACHMENT MEMBER BEING SIZED TO COOPERATE WITH SAID FIRST ATTACHMENT MEMBER WHEN SAID TAB IS FOLDED ABOUT SAID HINGE TO CLOSE SAID BLISTER PACKAGE;

FORMING A HOOK HOLE IN SAID MINOR PORTION OF SAID PERIPHERAL FLANGE;

FOLDING SAID MAJOR PORTION OF SAID PERIPHERAL FLANGE UPON ITSELF TO CREATE AT LEAST ONE CHANNEL; AND

FORMING A SECOND MEMBER HAVING AN OUTER PERIPHERY, SAID SECOND MEMBER BEING SIZED AND CONFIGURED TO BE RECEIVED WITHIN SAID AT LEAST ONE CHANNEL AND WHICH SPANS ACROSS SAID THREE-DIMENSIONAL BUBBLE WHEN SAID SECUREMENT MECHANISM IS IN A CLOSED POSITION, SAID SECOND MEMBER HAVING A FIRST END AND HAVING A HOOK HOLE FORMED THEREIN WHICH IS ALIGNED WITH SAID HOOK HOLE FORMED IN SAID FIRST MEMBER WHEN SAID SECOND MEMBER IS RETAINED WITHIN SAID AT LEAST ONE CHANNEL, SAID SECOND MEMBER HAVING A NOTCH FORMED THEREIN WHICH EXTENDS TO SAID OUTER PERIPHERY AND SURROUNDS SAID FIRST ATTACHMENT MEMBER WHEN SAID SECOND MEMBER IS RECEIVED IN SAID AT LEAST ONE CHANNEL, AND SAID SECOND MEMBER IS RETAINED WITHIN SAID AT LEAST ONE CHANNEL WHEN SAID SECUREMENT MECHANISM IS IN A CLOSED POSITION.

Fig. 15

A METHOD OF FORMING A BLISTER PACKAGE HAVING A SECUREMENT MECHANISM AND THEN INSERTING A PRODUCT THEREIN, SAID METHOD COMPRISING THE STEPS OF:

FORMING A FIRST MEMBER FROM A TRANSPARENT SHEET OF PLASTIC MATERIAL, SAID FIRST MEMBER HAVING A FRONT SURFACE, A BACK SURFACE, AND A THREE-DIMENSIONAL BUBBLE SURROUNDED BY A PERIPHERAL FLANGE HAVING A MAJOR PORTION AND A MINOR PORTION, SAID MINOR PORTION HAVING AT LEAST ONE AREA BOUNDED BY A PERFORATION LINE WHICH IS CAPABLE OF BEING BROKEN TO SEPARATE SAID BOUNDED AREA FROM SAID FIRST MEMBER, SAID BUBBLE BEING FORMED BETWEEN SAID FRONT AND BACK SURFACES AND BEING CAPABLE OF AT LEAST PARTIALLY RETAINING A PRODUCT, AND INTEGRALLY FORMING A SECUREMENT MECHANISM ON SAID MINOR PORTION OF SAID PERIPHERAL FLANGE, SAID SECUREMENT MECHANISM INCLUDING A PAIR OF FIRST ATTACHMENT MEMBERS FORMED ON SAID MINOR PORTION OF SAID PERIPHERAL FLANGE, A TAB EXTENDING OUTWARDLY FROM SAID MINOR PORTION OF SAID PERIPHERAL FLANGE AND HAVING A HINGE FORMED THEREIN, AND A PAIR OF SECOND ATTACHMENT MEMBERS FORMED IN SAID TAB OUTWARD OF SAID HINGE, SAID PAIR OF SECOND ATTACHMENT MEMBERS BEING SIZED TO COOPERATE WITH SAID PAIR OF FIRST ATTACHMENT MEMBERS WHEN SAID TAB IS FOLDED ABOUT SAID HINGE TO CLOSE SAID BLISTER PACKAGE;

FORMING A PAIR OF HOOK HOLES IN SAID MINOR PORTION OF SAID PERIPHERAL FLANGE;

FOLDING SAID MAJOR PORTION OF SAID PERIPHERAL FLANGE UPON ITSELF TO CREATE AT LEAST ONE CHANNEL;

FORMING A SECOND MEMBER HAVING AN OUTER PERIPHERY, SAID SECOND MEMBER BEING SIZED AND CONFIGURED TO BE RECEIVED WITHIN SAID AT LEAST ONE CHANNEL AND WHICH SPANS ACROSS SAID THREE-DIMENSIONAL BUBBLE WHEN SAID SECUREMENT MECHANISM IS IN A CLOSED POSITION, SAID SECOND MEMBER HAVING A FIRST END AND HAVING A PAIR OF HOOK HOLES FORMED THEREIN EACH OF WHICH IS ALIGNED WITH ONE OF SAID HOOK HOLES FORMED IN SAID FIRST MEMBER WHEN SAID SECOND MEMBER IS RETAINED WITHIN SAID AT LEAST ONE CHANNEL, SAID SECOND MEMBER HAVING A PAIR OF NOTCHES FORMED THEREIN EACH OF WHICH EXTENDS TO SAID OUTER PERIPHERY AND EACH OF WHICH SURROUNDS ONE OF SAID FIRST ATTACHMENT MEMBERS WHEN SAID SECOND MEMBER IS RECEIVED IN SAID AT LEAST ONE CHANNEL, AND SAID SECOND MEMBER IS RETAINED WITHIN SAID AT LEAST ONE CHANNEL WHEN SAID SECUREMENT MECHANISM IS IN A CLOSED POSITION;

INSERTING A PRODUCT INTO SAID THREE-DIMENSIONAL BUBBLE;

SLIDING SAID SECOND MEMBER INTO SAID AT LEAST ONE CHANNEL OF SAID FIRST MEMBER WHEN SAID SECUREMENT MECHANISM IS IN AN OPEN POSITION, SAID SECOND MEMBER RETAINING SAID PRODUCT IN SAID THREE-DIMENSIONAL BUBBLE; AND

FOLDING SAID TAB AT SAID HINGE WHEREBY SAID SECOND ATTACHMENT MEMBERS PASS THROUGH SAID PAIR OF NOTCHES AND ENGAGE WITH SAID PAIR OF FIRST ATTACHMENT MEMBERS TO CLOSE SAID BLISTER PACKAGE.

Fig. 16

BLISTER PACKAGE HAVING SECUREMENT MECHANISM AND METHOD OF FORMING AND FILLING THE BLISTER PACKAGE

CROSS-REFERENCE TO RELATED APPLICATION

This application is a Continuation-In-Part application which claims priority under 23 U.S.C. §120 to application Ser. No. 12/283,397, filed Sep. 10, 2008, now abandoned.

FIELD OF THE INVENTION

This invention relates to a blister package having a securement mechanism, and a method of forming and filling the blister package with one or more products.

BACKGROUND OF THE INVENTION

Today, many retail purchase decisions are made in the market aisles, when a customer encounters the desired goods. To make the act of product selection as simple and as satisfying as possible, manufacturers try to display their products in attractive and informative packaging. One particularly effective package for small to medium size items is the thermoformed blister package, either in a clamshell or with a paper backing card. The blister package, when made of transparent plastic, permits the customer to see the product directly. A blister package is also capable of containing one or multiple products.

While consumers seek an appealing product, appropriately displayed, they also desire to purchase a product at a competitive price. For this reason, packages have been designed to minimize the stocking and set-up time required of the merchant and/or jobber who must transfer the products from the shipping carton to the retail shelves. Although boxed goods are usually stacked one upon another, blister packages are typically displayed upright, hanging from a projecting hook or peg.

Most blister packages have one or more hook holes, and are placed, one after the other, on one or two hooks or pegs. Packages intended for the retail display of merchandise must meet several demanding requirements. Such packages should be designed so that they are easily loaded with product, contain one or more hook holes so that they can be readily mounted for display, and be aesthetically attractive in appearance. In addition, for many products, it is desirable that the customer be able to see the product directly.

In addition to the above mentioned requirements, many specialty retailers are encountering situations where a prospective purchaser wishes to remove the new product from the blister package and compare it to an existing product to make sure he or she is buying an identical replacement product. This is especially true for stores that sell automobile, truck, motorcycle, bicycle, etc. components where the customer is replacing an existing part. In these situations, the sales person would like to be able to open the blister package without destroying the package and remove the product so the customer can compare it to an existing product. If the product is not what the consumer desires, the retailer can then place the product back into the blister package and close it. In the past, a blister package could only be opened by tearing or cutting the package. If the product was not the desired product, the retailer then had to return the product and torn package back to the manufacturer for repackaging. Alternatively, the retailer had to tape the package closed and this tended to discourage other consumers from purchasing the product, fearing that the product had been tampered with.

Now a blister package has been invented with a securement mechanism which can be opened only once to avoid someone tampering with the product or products contained therein. A method of forming and filling the blister package is also disclosed.

SUMMARY OF THE INVENTION

Briefly, this invention relates to a blister package and a method of forming and filling the blister package. The blister package has a securement mechanism that can be opened only once. The blister package includes a first member having a front surface, a back surface and a three-dimensional bubble formed between the front and back surfaces. The three-dimensional bubble is capable of at least partially retaining a product therein. The first member also has a peripheral flange having a major portion and a minor portion. The major portion of the peripheral flange is folded upon itself to create at least one channel and the minor portion of the peripheral flange has a hook hole formed therethrough. The minor portion also has at least one area bounded by a perforation line which is capable of being broken to separate the boundary area from the first member. The securement mechanism is integrally formed on the minor portion. The securement mechanism includes a first attachment member formed on the minor portion, a tab extending outwardly from this minor portion and having a hinge formed therein, and a second attachment member formed in the tab outward of the hinge. The second attachment member is sized to cooperate with the first attachment member when the tab is pivoted about the hinge to close the blister package. The blister package further includes a second member sized and configured to be slideably received within the at least one channel when the securement mechanism is in an open position. The second member is retained within the at least one channel when the securement mechanism is in a closed position.

The method of forming a blister package having a securement mechanism includes the steps of forming a first member from a transparent sheet of plastic material. The first member has a front surface, a back surface and a three-dimensional bubble surrounded by a peripheral flange. The peripheral flange has a major portion and a minor portion. The minor portion of the peripheral flange has a hook hole formed therethrough. The minor portion also has at least one area bounded by a perforation line which is capable of being broken to separate the boundary area from the first member. The three-dimensional bubble is formed between the front and back surfaces and is capable of at least partially retaining a product. The securement mechanism is integrally formed on the minor portion of the peripheral flange. The securement mechanism includes a first attachment member formed on the minor portion, a tab extending outwardly from this minor portion and having a hinge formed therein, and a second attachment member formed in the tab, outward of the hinge.

The method further includes forming a second attachment member which is sized to cooperate with the first attachment member when the tab is folded about the hinge to close the blister package. This is accomplished by folding the major portion of the peripheral flange upon itself to create at least one channel. A second member is then sized and configured to fit within the at least one channel and span beyond the three-dimensional bubble when the securement mechanism is in an open position. The second member has an outer periphery, a first end with a hook hole formed therethrough, and a notch formed therein which extends to the outer periphery and surrounds the first attachment member when the second member is received in the at least one channel. The second member is retained within the at least one channel when the securement mechanism is in a closed position. The hook hole in the second member is aligned with the hook hole formed in the first member, and the notch is sized and configured to allow the second attachment member to pass therethrough once the tab on the first member is folded at the hinge.

The method of forming a blister package having a securement mechanism, and inserting a product therein, includes the steps of forming a first member from a transparent sheet of plastic material. The first member has a front surface, a back surface, and a three-dimensional bubble surrounded by a peripheral flange having a major portion and a minor portion. The minor portion of the peripheral flange has a hook hole formed therethrough. The minor portion also has at least one area bounded by a perforation line which is capable of being broken to separate the boundary area from the first member. The three-dimensional bubble is formed between the front and back surfaces and is capable of at least partially retaining a product. The securement mechanism is integrally formed on the minor portion of the peripheral flange. The securement mechanism includes a first attachment member formed on this minor portion, a tab extending outwardly from this minor portion and having a hinge formed therein, and a second attachment member formed in the tab, outward of the hinge.

The method further includes forming a second attachment member which is sized to cooperate with the first attachment member when the tab is pivoted about the hinge to close the blister package. This is accomplished by folding the major portion of the peripheral flange upon itself to create at least one channel. A second member is then sized and configured to fit within the at least one channel and span beyond the three-dimensional bubble when the securement mechanism is in a closed position. The second member has an outer periphery, a first end with a hook hole formed therethrough, and a notch formed therein which extends to the outer periphery and surrounds the first attachment member when the second member is received in the at least one channel. The second member is retained within the at least one channel when the securement mechanism is in a closed position. The hook hole in the second member is aligned with the hook hole formed in the first member, and the notch is sized and configured to allow the second attachment member to pass therethrough once the tab on the first member is folded at the hinge. The second member retains the product in the three-dimensional bubble. After the tab is folded on the hinge, the second attachment member passes through the notch and engages with the first attachment member to close the blister package.

The general object of this invention is to provide a blister package that can be opened only once. A more specific object of this invention is to provide a blister package that requires the bounded area of the first member to be removed by breaking the perforation line in order to remove the product from the package.

Another object of this invention is to provide a consumer friendly blister package and a method of forming and filling the blister package.

A further object of this invention is to provide an environmentally friendly blister package made from two different sustainable materials wherein each material can be separated and recycled into a new product.

Still another object of this invention is to provide a blister package and a method of forming that is cost effective and a method of filling the blister package with one or more products.

Still further, an object of this invention is to provide a blister package that visually displays the product which is being sold and which has a securement mechanism that can be broken off to open the blister package.

Other objects and advantages of the present invention will become more apparent to those skilled in the art in view of the following description and the accompanying drawings.

BRIEF DESCRIPTION OF THE DRAWINGS

FIG. 15 is a flow diagram of a method of forming a blister package having a securement mechanism that can be opened and closed only once.

FIG. 16 is a flow diagram of a method of forming a blister package having a securement mechanism that can be opened only once and closed only once.

DETAILED DESCRIPTION OF THE INVENTION

Figure 1:
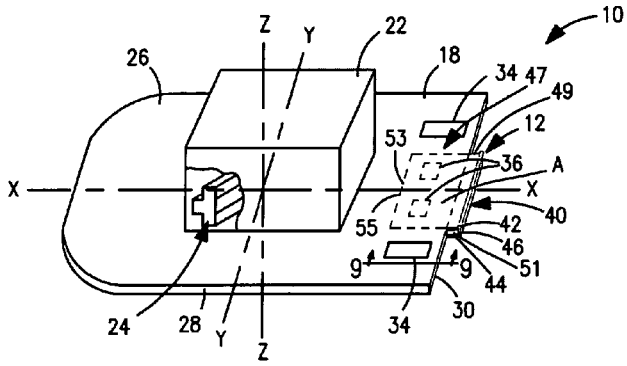
FIG. 1 is a perspective view of a blister package formed by securing a second member to a first member and depicts a partial cutaway of the three-dimensional bubble.

Referring to FIG. 1, a blister package 10 is shown having a securement mechanism 12 which can be opened only once.

Once the securement mechanism is opened, a visual indicator is provided notifying future customers that the blister package has already been opened. The blister package 10 has a three-dimensional configuration with a longitudinal central axis X-X, a transverse central axis Y-Y, and a vertical central axis Z-Z. In the packaging industry, blister packages are sometimes also referred to as clam shell packages, slide blister packages or seal blister packages.

Figure 5:
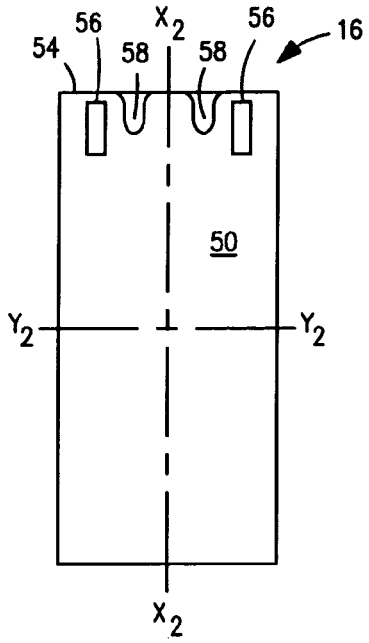
FIG. 5 is a front view of a second member sized and configured to slide in the at least one channel formed in the first member shown in FIG. 2, and having a pair of notches and a pair of hook holes formed therein.
Figure 6:
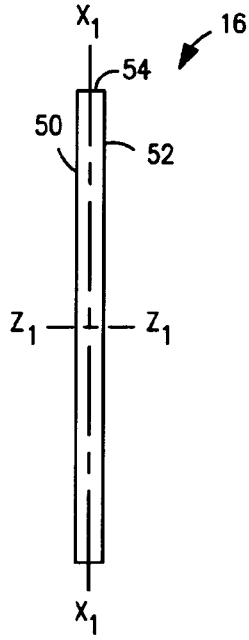
FIG. 6 is a side view of the second member shown in FIG. 5.

The blister package 10 includes a first member 14, see FIGS. 1-4, and a second member 16, see FIGS. 5 and 6. Each of the first and second members, 14 and 16 respectively, can be constructed from an identical, similar or different material. Desirably, the first member 14 is made from a different material than the second member 16. Each of the first and second materials, 14 and 16 respectively, can be formed from a sustainable material which will allow the first member 14 to be separated from the second member 16 so that each material can be recycled individually. This feature of sustainability will allow the materials from which each of the first and second members, 14 and 16 respectively, are constructed, to be recycled individually and reused in forming a new product.

The first member 14 can be constructed from a plastic material that is pliable and/or formable. Various ways of forming a plastic material are known to those skilled in the art. For example, the first member 14 can be formed by various known processes including but not limited to: thermoforming, molding, vacuum forming, injection molding, extruding material through a die, etc. Desirably, the first member 14 is a plastic material that is thermoformed. By "thermoformed" it is meant that a thin sheet of plastic material is placed in a mold and is heated to an elevated temperature, and then is subjected to a vacuum to create a three-dimensional shape. The blister package 10 can be manufactured in a thermoforming process, in which a single transparent sheet of heated thermoplastic material is positioned over a mold on which vacuum is drawn. The heated sheet is then drawn onto the mold and cooled, thereby assuming the shape of the mold. The molded article can then be withdrawn from the mold and trimmed to create the finished shape.

The first member 14 can be formed from various plastic and thermoplastics. The first member 14 can also be formed from a single composition or from a combination of two or more compositions. Specific plastic materials from which the first member 14 can be formed include but are not limited to: polyolefins, polyethylene terephthalate (PET), recycled polyethylene terephthalate (RPET), polyethylene terephthalate glycol (PETG), (PETE), polyvinyl chloride (PVC), polystyrene (PS), high impact polystyrene (HIPS), oriented polystyrene (OPS), recycled oriented polystyrene (ROPS), (PLA), polyethylene (PE), high density polyethylene (HDPE), polypropylene (PP), high density polypropylene (HDPP), polyurethane, as well as other suitable plastic materials known to those skilled in the art. The starting plastic sheet will generally be relatively flat having a thickness which ranges from between about 0.005 inches to about 0.05 inches.

Plastic materials that can be thermoformed are available from a number of different vendors. Three such vendors include: Spartech Corporation having an office at 120 South Central Avenue, Suite 1700, Clayton, Mo. 63105-1705; Premier Material Concepts having an office at 2040 Industrial Drive, Findlay, Ohio 45839-1605; and PACUR, having an office at 3555 Moser Street, Oshkosh, Wis. 54901

The first member 14 can be clear, transparent or opaque. By "clear" it is meant free from obscurities, unclouded. By "transparent" it is meant that the material is capable of transmitting light so that objects or images can be seen as if there were no intervening material. By "opaque" it is meant impenetrable by light; neither transparent nor translucent. Desirably, the first member 14 is clear. More desirably, the first member 14 is transparent. Clear and transparent packaging provides excellent visibility for faster consumer recognition of the product or products retained in the blister package 10. This helps the consumer select his or her preferred product.

Referring again to FIGS. 1-4, the first member 14 has a three-dimensional configuration with a longitudinal central axis $X_1$-$X_1$, a transverse central axis $Y_1$-$Y_1$, and a vertical central axis $Z_1$-$Z_1$. The first member 14 has a length l and a width w. The length l is measured parallel to the longitudinal central axis $X_1$-$X_1$ and the width w is measured parallel to the transverse central axis $Y_1$-$Y_1$. The length l and the width w can vary depending upon the size of the blister package 10 one needs. The first member 14 has a front surface 18, a back surface 20 and at least one three-dimensional bubble 22 formed between the front and back surfaces, 18 and 20 respectively. The three-dimensional bubble 22 can vary in size, shape and configuration. The three-dimensional bubble 22 can have almost any geometric shape that can be formed or molded. The geometric shapes include but are not limited to: a cube, a cylinder, a polygon, a parallelepiped, a pyramid, an irregular shape, etc. The three-dimensional bubble 22 can have a constant length and width along its height or it can be stepped or tapered so that the length and width dimensions decrease, increase or vary from the back surface 20 toward the front surface 18. The three-dimensional bubble 22 is designed to be capable of at least partially retaining a product 24 therein, see FIG. 1.

The first member 14 also has a peripheral flange 26. The peripheral flange 26 extends 360 degrees or completely around the three-dimensional bubble 22. The peripheral flange 26 can vary in dimension. For example, the peripheral flange 26 can range from between about 0.25 inches to about 12 inches. Desirably, the peripheral flange 26 will range from between about 0.3 inches to about 6 inches. More desirably, the peripheral flange 26 will range from between about 0.35 inches to about 3 inches. The peripheral flange 26 does not have to have a constant dimension on all sides of the bubble 22. For example, the peripheral flange 26 can have a greater dimension on one side of the bubble 22 and have smaller dimensions on the remaining sides.

Figure 2:
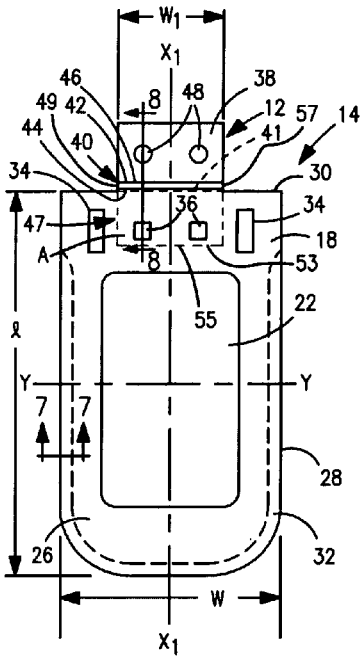
FIG. 2 is a front view of a first member having a front surface, a back surface, and a three-dimensional bubble formed between the front and back surfaces which is capable of at least partially retaining a product, the first member having a peripheral flange with a major portion of the peripheral flange being folded upon itself to form at least one channel, and a securement mechanism integrally formed on a minor portion of the peripheral flange.

Referring to FIG. 2, the peripheral flange 26 has a major portion 28 and a minor portion 30. The major portion 28 occupies, extends over or around more than 50% of the peripheral flange 26. Desirably, the major portion 28 occupies, extends over or around from between about 51% to about 95% of the peripheral flange 26. More desirably, the major portion 28 occupies, or extends over or around at least about 70% of the peripheral flange 26. Even more desirably, the major portion 28 occupies or extends over at least about 75% of the peripheral flange 26. Most desirably, the major portion 28 occupies, extends over or around at least about 80% of the peripheral flange 26.

The minor portion 30 of the peripheral flange 26 occupies, extends over or around less than about 50% of the peripheral flange 26. Desirably, the minor portion 30 occupies, extends over or around from between about 1% to about 49% of the peripheral flange 26. More desirably, the minor portion 30 occupies, extends over or around less than about 30% of the peripheral flange 26. Even more desirably, the minor portion 30 occupies, extends over or around less than about 25% of the peripheral flange 26. Most desirably, the minor portion 30 occupies, extends over or around less than about 20% of the peripheral flange 26. The minor portion 30 can be located on the length, width, or any part of the periphery of the blister package 10.

Figure 7:
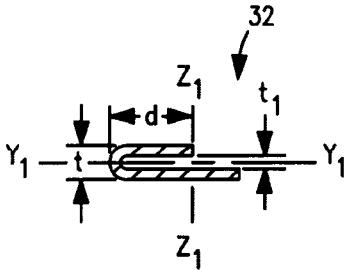
FIG. 7 is a cross-sectional view of a portion of the channel formed in the first member taken along line 7-7 of FIG. 2.

Referring now to FIGS. 2 and 7, the major portion 28 of the peripheral flange 26 is folded upon itself to create at least one channel. In FIG. 2, the channel 32 is depicted as a single channel which extends around about 80% of the peripheral flange 26. It should be noted that the channel 32 can be continuous or discontinuous. The channel 32 can also be formed as two or more separate and distinct channels each separated by a gap or void. The size and shape of the channel 32 can vary. In FIG. 7, the channel 32 is shown having a depth d, measured parallel to the transverse central axis $Y_1$-$Y_1$. The channel 32 also has an outside thickness t and an inside thickness $t_1$, both measured parallel to the vertical central axis $Z_1$-$Z_1$. The dimension of the depth d and the thicknesses t and $t_1$ can vary. Desirably, the depth d of the channel 32 can range from between about 0.1 inches to about 4 inches. More desirably, the depth d of the channel 32 can range from between about 0.2 inches to about 2 inches. Even more desirably, the depth d of the channel 32 can range from between about 0.25 inches to about 1.5 inches. Most desirably, the depth d of the channel 32 can range from between about 0.25 inches to about 1 inch.

The dimension of the outside thickness t of the channel 32 can range from between about 0.01 inches to about 0.5 inches. Desirably, the dimension of the outside thickness t of the channel 32 can range from between about 0.02 inches to about 0.25 inches. More desirably, the dimension of the outside thickness t of the channel 32 can range from between about 0.03 inches to about 0.2 inches. Even more desirably, the dimension of the outside thickness t of the channel 32 can range from between about 0.05 inches to about 0.1 inches.

The dimension of the inside thickness $t_1$ of the channel 32 can range from between about 0.01 inches to about 0.3 inches. Desirably, the dimension of the inside thickness $t_1$ of the channel 32 can range from between about 0.02 inches to about 0.25 inches. More desirably, the dimension of the inside thickness $t_1$ of the channel 32 can range from between about 0.03 inches to about 0.2 inches. Even more desirably, the dimension of the inside thickness $t_1$ of the channel 32 can range from between about 0.05 inches to about 0.1 inches.

Still referring to FIGS. 1 and 2, the first member 14 has at least one area (A) bounded by a perforation line 47. The perforation line 47 is capable of being broken to separate the bounded area (A) from the first member 14. The perforation line 47 extends from a first side 49 of a hinge 40 around a first attachment member 36 to a second side 51 of the hinge 40. The perforation line 47 can extend around two or more of the first attachment members 36, 36 when multiple first attachment members 36, 36 are present. In FIGS. 1 and 2, the perforation line 47 extends around both of the pair of first attachment members 36, 36. The perforation line 47 is shown contacting the minor portion 30 of the peripheral flange 26. The perforation line 47 can enclose a bounded area (A) of any desired geometrical shape. The enclosed or bounded area (A) can be in the configuration of a square, a rectangle, a circle, a semi-circle, a polygon, etc. A portion or one side of the bounded area (A) will be bounded by a portion of the minor portion 30 of the peripheral flange 26. The perforation line 47 is formed in the first member 14. The perforation line 47 consists of a plurality of land areas 53 each separated by a slot 55. The length of both the land areas 53 and the slots 55 can vary. For example, the slots 55 can be smaller, equal or larger in size to the land areas 53. In addition, the length of the land areas 53 can vary from one another and the length of the slots 55 can vary from one another. The slots 55 can extend partially or completely through the thickness of the first member 14. Desirably, the slots 55 extend completely through the thickness of the first member 14. The function of the perforation line 47 will be explained shortly.

The minor portion 30 of the peripheral flange 26 has at least one hook hole 34 formed therethrough. When a single hook hole 34 is utilized, it can be aligned with the longitudinal central axis $X_1$-$X_1$ of the first member 14. When two hook holes 34 are utilized, each can be spaced apart from the longitudinal central axis $X_1$-$X_1$ of the first member 14. A pair of spaced apart hook holes 34 is depicted in FIGS. 1 and 2. However, it should be obvious to one skilled in the art that any number of hook holes 34 can be utilized depending upon the size and weight of the blister package 10. For example, three or more hook holes 34 can be utilized. The size, shape and configuration of the hook hole(s) 34 can vary. Any geometrical shape can be utilized including but not limited to: a circle, an oval, an ellipse, a race track, a square, a rectangle, a triangle, a polygon, a hexagon, an irregular shape, etc. In FIGS. 1 and 2, the pair of hook holes 34 is depicted as having a race track profile.

Referring now to FIGS. 1-3 and 8, the securement mechanism 12 is formed on or with the minor portion 30 of the peripheral flange 26. Desirably, the securement mechanism 12 is integrally formed with the minor portion 30 of the peripheral flange 26. The securement mechanism 12 functions to provide security to the blister package 10 such that the product 24 retained therein cannot be easily separated from the blister package 10. The securement mechanism 12 permits the blister package 10 to be easily opened only once so as to prevent the product 24 from being tampered with or stolen. A visual indicator is provided once the blister package 10 is opened to alert subsequent consumers.

Figure 3:
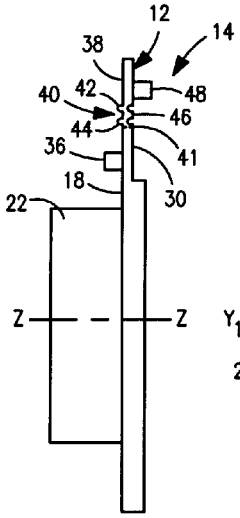
FIG. 3 is a side view of the first member shown in FIG. 2 depicting the securement mechanism in an open position.
Figure 4:
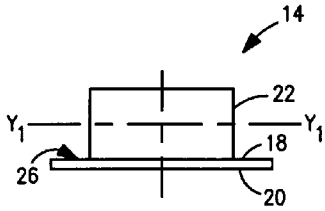
FIG. 4 is an end view of the first member shown in FIG. 2.

The securement mechanism 12 includes one or more first attachment member(s) 36 formed on the minor portion 30 of the peripheral flange 26. In FIGS. 1-3, a pair of first attachment members 36 is present. The pair of first attachment members 36 can be constructed to any desired geometrical configuration. As depicted in FIGS. 1-3 and 8, each of the pair of first attachment members 36 has a square cross-sectional configuration. Each of the pair of first attachment members 36 also has a hollow interior 37, see FIG. 8. The exact configuration of each of the hollow interiors 37 can also vary.

Referring again to FIG. 1, each of the pair of first attachment members 36 appears as a cube. Each of the first attachment members 36 can vary in size, shape and configuration. Each of the first attachment members 36 is spaced apart from one another and each is aligned on an opposite side of the longitudinal central axis $X_1$-$X_1$. Each of first attachment members 36 can be visualized as a hollow detent. The pair of the first attachment members 36 extends outward from the back surface 20 of the first member 14 in the same direction as the three-dimensional bubble 22. However, the pair of first attachment members 36 could extend in an opposite direction, if desired.

Referring to FIGS. 1-3 and 8, the securement mechanism 12 also includes a tab 38 extending outwardly from the minor portion 30 of the peripheral flange 26. The tab 38 is formed from the same plastic material that is used to form the first member 14. The tab 38 can be thermoformed or molded at the same time as the first member 14 is being formed. The tab 38 has a width $w_1$, measured parallel to the transverse central axis $Y_1$-$Y_1$, which is less than the width w of the first member 14. Desirably, the width $w_1$ of the tab 38 is less than half of the width w of the first member 14. More desirably, the width $w_1$ of the tab 38 is less than 48% of the width w of the first member 14. Even more desirably, the width $w_1$ of the tab 38 is less than 45% of the width w the first member 14. For example, the first member 14 could have a width w of 6.25 inches and the tab 38 could have a width $w_1$ of 2.75 inches.

The tab 38 has a hinge 40 formed therein. The hinge 40 can be of any size, shape or configuration. The hinge 40 can extend along the entire width $w_1$ of the tab 38 or along only a portion of the width $w_1$. The hinge 40 can be a living hinge, meaning that the hinge 40 will allow the tab 38 to fold, pivot, bend or rotate about the hinge 40 many times without failure. Alternatively, the hinge 40 can be almost any kind of hinge known to those skilled in the art. The hinge 40 can be constructed as one or more lines, segments or shaped structures. The material forming the hinge 40 can be thinner than the surrounding material, if desired. Desirably, the hinge 40 is formed from the same material that is used to form the tab 38.

The tab 38 can optionally contain a perforated line 41 which would allow the tab 38 to be easily separated from the first member 14, if desired. Sometimes, the retailer would like to remove the tab 38. Alternatively, the perforated line 41 could also be constructed as a thinned line which extends along or across the width $w_1$ of the tab 38.

Returning to FIGS. 1 and 3, the hinge 40 is depicted as being constructed from a pair of semi-circular shaped members, 42 and 44, which are aligned parallel to one another. The thickness of each of the semi-circular shaped members 42 and 44 is the same and is equal in thickness to the adjacent material forming the tab 38. The pair of semi-circular shaped members, 42 and 44, is spaced apart from one another by an intermediate member 46. The intermediate member 46 can be flat, planar or curved in appearance. The width of the intermediate member 46 can vary. Typically, the intermediate member 46 has a width ranging from between about 0.01 inches to about 1 inch.

Referring again to FIGS. 1-3, 8 and 9, the securement mechanism 12 further includes one or more second attachment member(s) 48 formed in the tab 38. A pair of second attachment members 48, 48 is depicted in FIGS. 1 and 2. Each of the pair of second attachment members 48, 48 has a round or circular cross-sectional configuration. Each of the second attachment members 48, 48 also has a hollow interior 57, see FIG. 8. The exact configuration of each of the hollow interiors 57,57 can vary. The exact size, shape and configuration of each of the second attachment members 48, 48 can also vary. Each of the second attachment members 48, 48 is spaced apart from one another and each is aligned on an opposite side of the longitudinal central axis $X_1$-$X_1$. Each of the second attachment members 48, 48 can be visualized as a hollow projection. The second attachment members 48, 48 are located outward of the hinge 40. Stated another way, the second attachment members 48, 48 are located on one side of the hinge 40 and the first attachment members 36, 36 are located on the other side of the hinge 40. It should be noted that the second attachment members 48, 48 are formed on the tab 38 while the first attachment members 36, 36 are formed in the minor portion 30 of the peripheral flange 26. Each of the second attachment members 48, 48 is sized to cooperate with one of the first attachment members 36, 36 when the tab 38 is folded or pivoted about the hinge 40 so as to close the blister package 10. Normally the tab 38 can pivot on the hinge 40 through an angle of from between about 0 degrees to about 270 degrees. Desirably, the tab 38 will be able to pivot on the hinge 40 through an angle of at least about 180 degrees.

Figure 8:
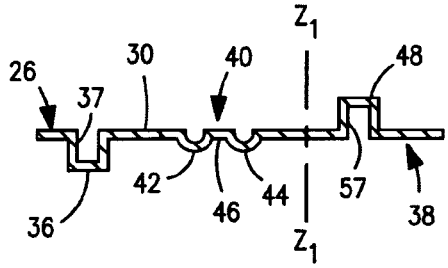
FIG. 8 is a cross-sectional view of a portion of the first member and the securement mechanism taken along line 8-8 of FIG. 2.
Figure 9:
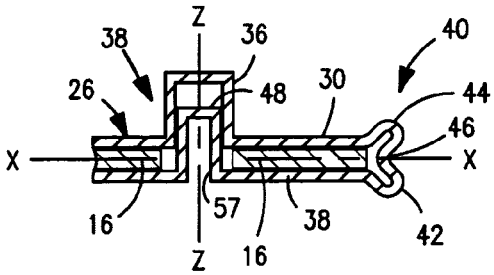
FIG. 9 is an exploded cross-sectional view taken along line 9-9 of FIG. 1 showing the first and second attachment members engaged in an interference fit.

Referring now to FIGS. 2, 8 and 9, one will notice that each of the second attachment members 48, 48 is depicted having a circular cross-sectional configuration with a hollow interior 57, 57. In perspective view, each of the second attachment members 48, 48 appears as a cylinder. Each of the second attachment members 48, 48 extends outward from the front surface 18 of the first member 14 in an opposite direction to the first attachment members 36, 36. If desired, the orientation of the first and second attachment members, 36, 36 and 48, 48 can be reversed. In addition, each of the second attachment members 48, 48 can have the same configuration as each of the first attachment members 36, 36. The circular cross-sectional configuration of each of the second attachment members 48, 48 is sized to engage with the hollow interiors 37, 37 of one of the square cross-sectional configurations of each of the first attachment members 36, 36, see FIG. 9. The engagement can be a friction fit, an interference fit, a snug fit, etc. Desirably, the engagement is an interference fit. The positive engagement between the first and second attachment members, 36 and 48 respectively, is sufficient to ensure that the tab 38 will form a closure with the first member 14. The hollow interior configuration 37 and 57 of the first and second attachment members, 36 and 48 respectively, will allow one or both members to slightly deform if needed so that each of the second attachment members 48 can engage with the hollow interior 37 of one of the first attachment members 36.

Furthermore, each of the second attachment members 48, 48 is permanently secured to one of the hollow interiors 37, 37 of one of the first attachment members 36, 36 by using a chemical bonding agent, heat, heat and pressure, or by welding. Examples of a chemical bonding agent include but are not limited to: glue, ultra violet glue, an epoxy, or an adhesive. The first and second attachment members, 36 and 48 respectively, can also be bonded together using heat, heat and pressure, thermal energy to form a thermal bond, or be welded together such as by thermal-welding, or other welding procedures known to those skilled in the art. For example, the second attachment member 48 can be thermally welded to the hollow interior 37 of the first attachment member 36. The bonding or welding can occur after the blister package 10 has been filled with one or more products 24 by the manufacturer. When the second attachment member 48 is bonded, welded, glued or secured in some other manner to the first attachment member 36, the securement mechanism 12 cannot be opened without destroying the blister package 10. In this case, the perforation line 47 has to be broken and the bounded area (A), containing the first and second attachment members, 36 and 48 respectively, will be physically separated from the remainder of the blister package 10. This separation will provide visual evidence that the blister package 10 has been tampered with. The retailer will be forced to send the product 24 back to the manufacturer to be repackaged.

Referring to FIGS. 5 and 6, the blister package 10 also includes the second member 16 having a longitudinal central axis $X_2$-$X_2$, a transverse central axis $Y_2$-$Y_2$, and a vertical central axis $Z_2$-$Z_2$. The second member 16 is sized and configured to be slideably received within the at least one channel 32 when the securement mechanism 12 is in an open position. The second member 16 is retained within the at least one channel 32 when the securement mechanism 12 is in a closed position. The second member 16 can be a display card formed or constructed of various materials, including but not limited to: paper, heavy weight paper, paperboard, cardboard, plastic, a laminate formed from two or more layers of materials, a composite formed from two or more materials, a ferrous metal, a non-ferrous metal, tin, an alloy, wood, etc. Desirably, the second member 16 is formed from heavy weight paper, paper board or cardboard. The second member 16 can be one to several millimeters thick. Desirably, the second member 16 is less than 10 millimeters thick.

The second member 16 has a first surface 50 and an oppositely aligned second surface 52. At least one of the first and second surfaces, 50 and 52 should be capable of being printed and/or colored. Desirably, both of the first and second surfaces, 50 and 52, can be printed and/or colored. By "printed" it is meant that letters, words, numbers, marks, images, photos, sketches, pictures, etc. can be printed, transferred, typed or otherwise marked on a material such as by hand, by a printing press, a printer, an inkjet printer, a computer operated printer, or other means.

The first or second surfaces, 50 and 52 of the second member 16 can also be printed with instructional material as how to use the product or products retained within the blister package 10 and/or have a label or bar code placed thereon. Likewise, an adhesive (not shown) could be secured to the second surface 52 of the second member 16 which could support a sticker, label or serve as a means for attaching or affixing the blister package 10 to another object or product.

The second member 16 can also be constructed from an environmentally friendly material that is recyclable. Paperboard and cardboard are two materials that are easily recyclable using know techniques. It should also be recognized that the second member 16 can be easily separated from the first member 14 which will facilitate recycling of the first and second members, 14 and 16 respectively.

Still referring to FIGS. 5 and 6, the second member 16 has an outer periphery and a first end 54. When the second member 16 is assembled with the first member 14, the first end 54 will be located adjacent to the securement mechanism 12. The second member 16 can have one or more hook holes 56 formed therein, as well as one or more notches 58 formed therein. A pair of hook holes 56, 56 and a pair of notches 58, 58 is depicted in FIG. 5. The pair of hook holes 56, 56 are sized and configured to align with the pair of hook holes 34, 34 formed in the first member 14. The hook holes 34 and 56 provide a convenient way to support the blister package 10 for display at a retailer's place of business.

Each of the pair of hook holes 56, 56 is located on an opposite side of the longitudinal central axis $X_2$-$X_2$. In addition, each of the pair of notches 58, 58 is located on an opposite side of the longitudinal central axis $X_2$-$X_2$. In FIG. 5, each of the pair of notches 58, 58 is located closer to the longitudinal central axis $X_2$-$X_2$ than the pair of hook holes 56, 56. Desirably, each of the pair of notches 58, 58 is aligned adjacent to one of the pair of hook holes 56, 56.

A portion of each of the pair of notches 58, 58 extends to the outer periphery of the second member 16. In addition, each of the pair of notches 58, 58 surrounds one of the first attachment members 36, 36 when the second member 16 is received in the at least one channel 32. Each of the pair of notches 58, 58 is be sized to be larger than each of the first attachment members 36, 36 to allow for movement of the second member 16 within the at least one channel 32. It should be understood that each of the second attachment members 48, 48 will be able to pass through one of the pair of notches 58, 58 when the tab 38 is folded on the hinge 40. By folding the tab 38, each of the second attachment members 48, 48 can pass through one of the pair of notches 58, 58 formed in the second member 16 and engage with the hollow interior 37 of one of the pair of first attachment members 36, 36.

When the second member 16 is slid into the channel 32 formed in the first member 14, the pair of notches 58, 58 will line up and be located within the bounded area (A) defined by the perforation line 47. If the perforation line 47 is broken, the second member 16 can be removed from the first member 14 and the product or products 24 housed within the blister package 10 can be removed and examined. However, the blister package 10 cannot be closed and regain its original appearance since the bounded area (A), defined by the perforation line 47, will have been removed and cannot be reassembled.

Referring now to FIGS. 10-14, another embodiment of a blister package 10' is shown. Identical numbers, which are primed, will be used to identify like structure as appeared in FIGS. 1-9. The blister package 10' has a first member 14' and a second member 16' which can be assembled in a similar fashion as was explained above with reference to the first embodiment of the blister package 10'. The blister package 10' includes a securement mechanism 12' which can be glued, bonded or welded such that the first and second attachment members 36' and 48' will prevent the blister package 10' from being opened more than once.

The first member 14' can be formed from a clear and/or transparent material. The first member 14' has an approximately rectangular configuration with a first side 60, a second side 62, a first end 64, and a second end 66. The first member 14' also has a front surface 18', a back surface 20' and a three-dimensional bubble 22' formed between the front and back surfaces, 18' and 20' respectively, which is capable of at least partially retaining a product (not shown).

The first member 14' has a peripheral flange 26' which extends outward from the first and second sides, 60 and 62 respectively, and from the first and second ends, 64 and 66 respectively. A major portion 28' of the peripheral flange 26' is folded upon itself at the first and second sides, 60 and 62 respectively, and at the second end 66 to create a first channel 68, a second channel 70, and a third channel 72. One will notice that the first channel 68 is spaced apart and separated from the second channel 70 by a gap or void 74. Likewise, the second channel 70 is spaced apart and separated from the third channel 72 by a gap or void 76. The size and shape of the gaps 74 and 76 can vary. Each of the first, second and third channels, 68, 70 and 72 respectively, can vary in depth d, outside thickness t, and inside thickness $t_1$. Desirably, each of the first, second and third channels, 68, 70 and 72 respectively, has a depth d of at least about 0.25 inches and an outside thickness t of at least about 0.5 inches. The inside thickness $t_1$ can range from between about 0.01 inches to about 0.3 inches.

The remaining minor portion 30' of the peripheral flange 26', located adjacent to the first end 64, is not folded and has a pair of hook holes 34', 34' formed therethrough. It should be noted that any number of hook holes 34' can be utilized. Normally one, two or three hook holes 34' are used depending upon the size, configuration and weight of the blister package 10'. The first member 14' further has at least one area (A') bounded by a perforation line 47' which is capable of being broken to separate the bounded area (A') from the first member 14'. The perforation line 47' extends from a first side 49' of the hinge 40' around at least one of first attachment members 36', 36', to a second side 51' of the hinge 40'. Desirably, the perforation line 47' extends around both of the pair of first attachment members 36', 36'. The perforation line 47' is shown contacting the minor portion 30' of the peripheral flange 26'. The perforation line 47' can enclose an area (A') of any desired geometrical shape. The enclosed or bounded area (A') can be in the configuration of a square, a rectangle, a circle, a semi-circle, a polygon, etc. A portion or one side of the enclosed area (A') within the perforation line 47' will be bounded by a portion of the minor portion 30' of the peripheral flange 26'. The perforation line 47' is formed in the first member 14'. The perforation line 47' consists of a plurality of land areas 53' each separated by a slot 55'. The length of both the land areas 53' and the slots 55' can vary. For example, the slots 55' can be smaller, equal or larger in size to the land areas 53'. In addition, the length of the land areas 53' can vary from one another and the length of the slots 55' can vary from one another. The slots 55' can extend partially or completely through the thickness of the first member 14. Desirably, the slots 55' extend completely through the thickness of the first member 14'. The function of the perforation line 47' is the same as was explained above with reference to the blister package 10.

Figure 10:
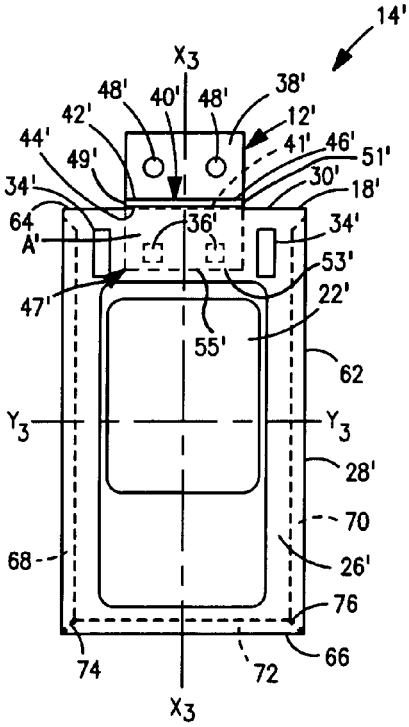
FIG. 10 is a front view of another embodiment of a first member having an approximate rectangular configuration with first and second sides and first and second ends, and having a front surface, a back surface, and a three-dimensional bubble formed between the front and back surfaces which is capable of at least partially retaining a product, the first member having a peripheral flange which is folded upon itself along the first and second sides and along the second end to form first, second and third channels, and a securement mechanism integrally formed adjacent to the first end of the first member.
Figure 11:
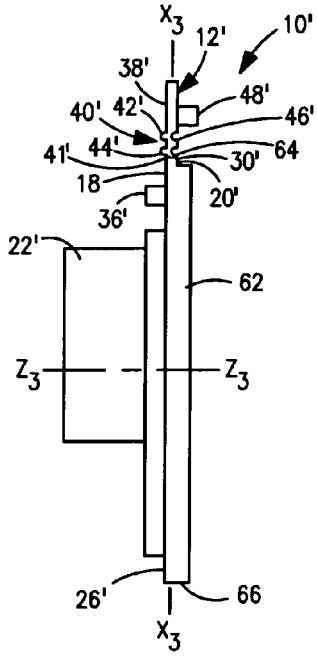
FIG. 11 is a side view of the first member shown in FIG. 10 depicting the securement mechanism in an open position.
Figure 12:
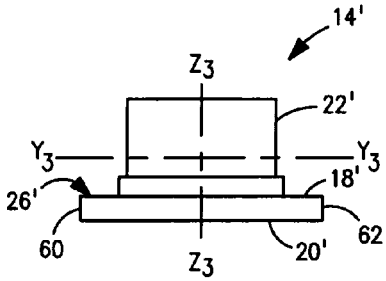
FIG. 12 is an end view of the first member shown in FIG. 10.

Referring to FIGS. 10 and 11, the first member 14' also includes a securement mechanism 12' which can be integrally formed with the peripheral flange 26' when the first member 14' is thermally formed or molded. The securement mechanism 12' is located adjacent to the first end 64. The securement mechanism 12' can be glued, bonded or welded such that the first and second attachment members, 36' and 48' respectively, will prevent the blister package 10' from being opened more than once. When the first and second attachment members, 36' and 48' respectively, are secured to one another by using glue, a chemical or thermal bond or by a weld, the blister package 10' can be opened but cannot be reclosed to its original configuration. In this case, a visual clue will be present to alert future customers that the blister package 10' has been tampered with.

The securement mechanism 12' includes a pair of first attachment members 36', 36' formed on the peripheral flange 26' adjacent to the first end 64. It should be understood that one or more first attachment members 36' can be utilized. Two first attachment members 36', 36' are shown in FIG. 10. The securement mechanism 12' also includes a tab 38' which extends outwardly from the peripheral flange 26' adjacent to the first end 64. The tab 38' has a hinge 40' formed therein. The hinge 40' can be a living hinge.

The tab 38' can be secured to the minor portion 30' of the peripheral flange 26' by a perforated line 41'. The perforated line 41' allow one to separated and remove the tab 38' from the minor portion 30', if desired.

The hinge 40' can be constructed as explained above with reference to the first embodiment. For example, the hinge 40' can include a first semi-circular member 42' aligned parallel to a second semi-circular member 44'. The first semi-circular member 42' can be spaced apart from the second semi-circular member 44' by an intermediate member 46'. Various other designs for constructing the hinge 40' can be used which are known to those skilled in the art. The securement mechanism 12' further includes a pair of second attachment members 48' formed in the tab 38' and located outward of the hinge 40'. Each of the second attachment members 48' is sized to cooperate with one of the first attachment members 36' when the tab 38' is pivoted about the hinge 40' to close the blister package.

Figure 13:
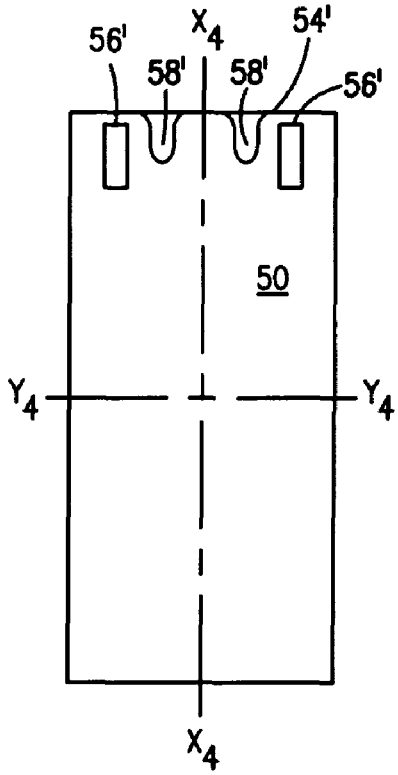
FIG. 13 is a front view of a second member sized and configured to slide in the first, second and third channels formed in the first member shown in FIG. 10, and having a pair of notches and a pair of hook holes formed therein.
Figure 14:
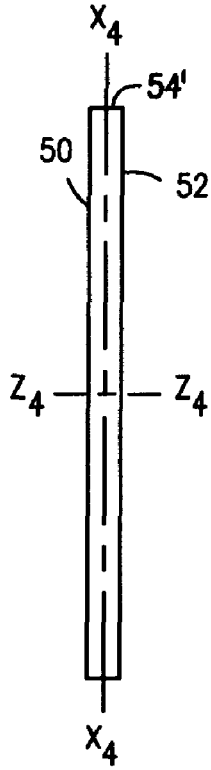
FIG. 14 is a side view of the second member shown in FIG. 13.

Referring to FIGS. 13 and 14, the blister package 10' further includes a second member 16', in the form of a display card. The second member 16' has an outer periphery and a first end 54'. The second member 16' is sized and configured to be slideably received within the first, second and third channels, 68, 70 and 72, of the first member 14' when the securement mechanism 12' is in an open position. When the second member 16' is assembled with the first member 14', the first end 54' will be located adjacent to the securement mechanism 12'. The second member 16' can have one or more hook holes 56' formed therein as well as one or more notches 58' formed therein. A pair of the hook holes 56', 56' and a pair of the notches 58', 58' is depicted in FIG. 13. The pair of hook holes 56', 56' are sized and configured to align with the pair of hook holes 34', 34' formed in the first member 14'. The hook holes 34' and 56' provide a convenience way to support the blister package 10' for display at a retailer's place of business.

Each of the pair of hook holes 56', 56' is located on an opposite side of the longitudinal central axis $X_4$-$X_4$. In addition, each of the pair of notches 58, 58 is located on an opposite side of the longitudinal central axis $X_4$-$X_4$. In FIG. 13, each of the notches 58' is located closer to the longitudinal central axis $X_4$-$X_4$ than the pair of hook holes 56', 56'. Desirably, one of the pair of notches 58' is aligned adjacent to one of the pair of hook holes 56'.

A portion of each of the pair of notches 58', 58' extends to the outer periphery of the second member 16'. In addition, each of the pair of notches 58', 58' surrounds one of the first attachment members 36', 36' when the second member 16' is received in the channels 68, 70 and 72. Each of the pair of notches 58', 58' is sized to be larger than each of the pair of first attachment members 36', 36' so as to allow for movement of the second member 16' within the channels 68, 70 and 72. It should be understood that each of the pair of second attachment members 48', 48' will be able to pass through one of the pair of notches 58', 58' when the tab 38' if folded on the hinge 40'. By folding the tab 38', each of the second attachment members 48', 48' can pass through one of the pair of notches 58', 58' and engage with the hollow interior 37 of each of the first attachment members 36', 36'.

When the second member 16' is slid into the channels 68, 70 and 72 formed in the first member 14', the pair of notches 58', 58' will line up and be located within the area defined by the perforation line 47'. If the perforation line 47' is broken, the second member 16' can be removed from the first member 14' and the product or products housed within the blister package 10' can be removed and examined. However, the blister package 10' cannot be closed and regain its original appearance since the bounded area (A') defined by the perforation line 47' will have been removed and cannot be reassembled.

The second member 16' is retained within the first, second and third channels, 68, 70 and 72 respectively, when the tab 38' of the securement mechanism 12' is folded into a closed position. In the closed position, the second member 16' is surrounded by the first, second and third channels, 68, 70 and 72 respectively, and the pair of second attachment members 48', 48' engage with the pair of first attachment members 36', 36'. In this position, the securement mechanism 12' is in a closed position.

It should also be understood that the blister package 10 or 10' is considered to be tamper resistant or tamper proof because the securement mechanism 12 or 12' is permanently secured, sealed or affixed to the first member 14 or 14'. By applying an adhesive or glue, by bonding or welding or by crushing or thermal-welding one or more of the pair of second attachment members 48, 48' into the pair of first attachment members 36, 36', a tamper resistant or tamper proof blister package 10 or 10' is formed. In addition, the back surface 20 of the securement mechanism 12 or 12' can be folded at the hinge 40 or 40' and be secured to itself so as to form a permanent attachment. After the blister package 10 or 10' has served it's useful purpose, the first plastic member 14 or 14' can be separated from the second cardboard member 16 or 16' because the plastic member 14 or 14' is not sealed to the cardboard member 16 or 16'. This is advantageous because the components of the blister package 10 or 10' can still be classified as being sustainable. Many manufacturers today like to be able to tout their products as being packaged and sold in sustainability packages. In addition, some consumers even refuse to buy products that are not packaged in recyclable, environmentally friendly materials.

Method

Referring to FIG. 15, a method of forming a blister package 10 or 10', having a securement mechanism 12 or 12' will now be explained. The method includes the steps of forming a first member 14 or 14' from a transparent sheet of plastic material. The first member 14 or 14' has a front surface 18 or 18', a back surface 20 or 20' and a three-dimensional bubble 22 or 22' surrounded by a peripheral flange 26 or 26'. The peripheral flange 26 or 26' has a major portion 28 or 28' and a minor portion 30 or 30'. The minor portion 30 or 30' has at least one area (A) or (A') bounded by a perforation line 47 or 47' which is capable of being broken to separate the bounded area (A) or (A') from the first member 14 or 14'. The bubble 22 or 22' is formed between the front and back surfaces, 18 or 18' and 20 or 20' respectively, and the bubble 22 or 22' is capable of at least partially retaining a product 24. The securement mechanism 12 or 12' is integrally formed on the minor portion 30 or 30' of the peripheral flange 26 or 26'. The securement mechanism 12 or 12' permits the blister package 10 or 10' to be opened only once. The securement mechanism 12 or 12' includes one or more first attachment members 36 or 36' formed on a minor portion 30 or 30'. The securement mechanism 12 or 12' also includes a tab 38 or 38' which extends outwardly from the minor portion 30 or 30'. The tab 38 or 38' has a hinge 40 or 40' formed therein. Desirably, the hinge 40 or 40' is a living hinge. The tab 38 or 38' can be joined to the first member 14 or 14' by a breakable, perforated line 41 or 41', if desired. A perforation line 47 or 47' extends from a first side 49 or 49' of the hinge 40 or 40' around the first attachment member 36 or 36' to a second side 51 or 51' of the hinge 40 or 40'. The perforation line 47 or 47' can extend around two or more of the first attachment members 36, 36 or 36'. 36' when two or more first attachment members 36, 36 or 36', 36' are present. The securement mechanism 12 or 12' further includes one or more second attachment members 48, 48 or 48', 48' formed in the tab 38 or 38' outward of the hinge 40 or 40'. Desirably, the number of second attachment members 48, 48, or 48', 48' equals the number of first attachment members 36, 36 or 36', 36'. One or more hook holes 34, 34 or 34', 34' are then formed in the minor portion 30 or 30' of the peripheral flange 26 or 26'. It should be understood that the one or more hook holes 34, 34 or 34', 34' can be formed at a later time, if desired. Each of the second attachment members 48, 48 or 48', 48' is sized and configured to cooperate with one of the first attachment members 36, 36 or 36', 36' when the tab 38 or 38' is folded or pivoted at the hinge 40 or 40' to close the blister package 10 or 10'.

The method also includes folding a major portion 28 or 28' of the peripheral flange 26 or 26' upon itself to create at least one channel 32. The method further includes assembling, fitting or sliding a second member 16 or 16' within the at least one channel 32. Desirably, three channels 68, 70 and 72 are present. The second member 16 or 16', when assembled within the at least one channel 32 of the first member 14 or 14', will span across the three-dimensional bubble 22 or 22'. The second member 16 or 16' has a first end 54 or 54' which is located adjacent to the securement mechanism 12 or 12'.

The method also includes forming a second member 16 or 16'. The second member 16 or 16' has an outer periphery. The second member 16 or 16' is sized and configured to be received within the at least one channel 32 and will span across the three-dimensional bubble 22 or 22' when the securement mechanism 12 or 12' is in a closed position. The second member 16 or 16' has a first end 54 or 54' and one or more hook holes 56 or 56' formed therein. Two hook holes 56 and 56 are depicted in FIG. 5, and two hook holes 56' and 56' are depicted in FIG. 13. Each of the hook holes 56, 56 or 56', 56' is aligned with one of the hook holes, 34, 34 or 34' 34' respectively, formed in the first member 14 or 14' when the second member 16 or 16' is retained within the at least one channel 32 or the channels 68, 70 and 72. The second member 16 or 16' also has one or more notches 58 or 58' formed therein. Two notches 58, 58 are shown in FIG. 5, and two notches 58', 58' are shown in FIG. 13. Each of the notches 58, 58 or 58', 58' extends to the outer periphery of the second member 16 or 16'. In addition, each of the notches 58, 58 or 58', 58' surround one of the first attachment members 36 or 36' when the second member 16 or 16' is received in the at least one channel 32 or the channels 68, 70 and 72. With the second member 16 or 16' assembled in the first member 14 or 14', the tab 38 or 38' can be folded on the hinge 40 or 40'. When the tab 38 or 38' is folded, each of the second attachment members 48, 48 or 48', 48' will be able to pass through the notches 58, 58 or 58', 58' and engage with one of the first attachment members 36, 36 or 36', 36'. In so doing, the second member 16 or 16' will be held secure in a set position relative to the first member 14 or 14'. The second member 16 or 16' is retained within the at least one channel 32 or the channels 68, 70 and 72 when the securement mechanism 12 or 12' is in a closed position.

It should be understood that the product 24 is first positioned in the three-dimensional bubble 22 or 22' before the second member 16 or 16' is fitted or slid into the at least one channel 32 or the channels 68, 70 and 72. With the second member 16 or 16' secured to the first member 14 or 14' by the securement mechanism 12 or 12', the product 24 cannot be removed from the blister package 10 or 10' unless the securement mechanism 12 or 12' is opened or the blister package 10, or 10' is physically destroyed. If a customer wished to compare the packaged product 24 to an existing product or part, he or she can ask the sales clerk to open the blister package 10 or 10' so that the product 24 can be removed. Alternatively, the consumer can open the blister package 10 or 10' by himself or herself by separating the second attachment member 48 or 48' from the first attachment member 36 or 36'. This can be accomplished by folding the tab 38 or 38' outward at the hinge 40 or 40' through an angle approaching about 180 degrees or more to an open position. Alternatively, when the first and second attachment members, 36 and 48, or 36' and 48', are permanently bonded or welded together, the area (A) or (A') bounded by the perforation line 47 or 47' is separated from the first member 14 or 14' by physically breaking the land areas 53 of the perforation line 47 or 47'. The bounded area (A) or (A') is physically removed from the first member 14 or 14' which allows the second member 16 or 16' to be removed from the channel 32 or the channels 68, 70 and 72. The product 24 can then be inspected. However, once the area (A) or (A') has been physically removed from the first member 14 or 14', it cannot be easily reattached. One would have to use tape or glue to reattach the area (A) or (A') and this would provide a visual cue to a subsequent customer that the blister package 10 or 10' had been previously opened. Once the blister package 10 or 10' has been opened by a consumer before the product 24 is purchased, and assuming that the product 24 is not purchased, the retailer has to send the product 24 and the blister package 10 or 10' back to the manufacturer to be repackaged. In this scenario, the securement mechanism 12 or 12' prevents the blister package 10 or 10' from being opened more than once.

In the embodiment were the first and second attachment members, 36 and 48 or 36' and 48', are not bonded or welded together, the blister package 10 or 10' can be opened and reclosed without any visual sign that this has occurred. In this situation, the second member 16 or 16' is slid at least partially out of the at least one channel 32 or the channels 68, 70 and 72 and away from the first member 14 or 14'. With the second member 16 or 16' slid passed the three-dimensional bubble 22 or 22', the consumer will be able to remove the product 24 from the blister package 10 or 10'. After the product 24 has been examined by the consumer, it can easily be placed back into the three-dimensional bubble 22 or 22' and the second member 16 or 16' can again be slid back in to the at least one channel 32 or the channels 68, 70 and 72. At this point, the tab 38 or 38' is folded at the hinge 40 or 40' back to the closed position and the second attachment members 48, 48 or 48', 48' are secured into the first attachment members 36, 36 or 36', 36' by pressing on the exterior surface of the tab 38 or 38'. This will cause the second attachment members 48, 48 or 48', 48' to pass through the notches 58, 58 or 58', 58' formed in the second member 16 or 16' and engage with the first attachment members 36, 36 or 36', 36'. An audible sound is generated when the second attachment members 48, 48 or 48', 48' engage with the first attachment members 36, 36 or 36', 36' which alerts the sales clerk and/or the consumer that the securement mechanism 12 or 12' on the blister package 10 or 10' is closed. The audible sound can be similar to the sound made when one pops a blister on a bubble pack.

Turning now to FIG. 16, a method of forming a blister package 10 or 10', having a securement mechanism 12 or 12' and inserting a product 24 therein will now be explained. This method includes the steps of forming a first member 14 or 14' from a transparent sheet of plastic material. For example, the first member 14 or 14' can be thermoformed. The first member 14 or 14' has a front surface 18 or 18', a back surface 20 or 20', and a three-dimensional bubble 22 or 22'. The three-dimensional bubble 22 or 22' is surrounded by a peripheral flange 26 or 26'. The peripheral flange 26 or 26' has a major portion 28 or 28' and a minor portion 30 or 30'. The minor portion 30 or 30' has at least one area (A) or (A') bounded by a perforation line 47 or 47' which is capable of being broken to separate the bounded area (A) or (A') from the first member 14 or 14'. The three-dimensional bubble 22 or 22' is formed between the front and back surfaces, 18 and 20 or 18' and 20' respectively, and is capable of at least partially retaining a product 24. The securement mechanism 12 or 12' is integrally formed on the minor portion 30 or 30' of the peripheral flange 26 or 26'.

The securement mechanism 12 or 12' includes a first attachment member 36 or 36' formed on the minor portion 30 or 30' of the peripheral flange 26 or 26', a tab 38 or 38' extending outwardly from the minor portion 30 or 30' and having a hinge 40 or 40' formed therein, and a pair of second attachment members 48, 48 or 48', 48' formed in the tab 38 or 38' outward of the hinge 40 or 40'. The pair of second attachment members 48, 48 or 48', 48' are sized to cooperate with the pair of first attachment members 36, 36 or 36', 36' when the tab 38 or 38' is folded about the hinge 40 or 40' to close the blister package 10 or 10'.

The method also includes forming one or more hook holes 34, 34 or 34', 34' in the minor portion 30 or 30' of the peripheral flange 26 or 26'. A pair of hook holes 34, 34 is shown in FIGS. 1 and 2 and a pair of hook holes 36', 36' is shown in FIG. 10. The one or more hook holes 34 or 34' can be formed at a later time, if desired. The second attachment members 48, 48 or 48', 48' are sized and configured to cooperate with the first attachment members 36, 36 or 36', 36' when the tab 38 or 38' is folded at the hinge 40 or 40' to close the blister package 10 or 10'.

The method further includes folding the major portion 28 or 28' of the peripheral flange 26 or 26' upon itself to create at least one channel 32 or the channels 68, 70 and 72. A single channel 32 is shown in FIG. 2 and the three channels 68, 70 and 72 are shown in FIG. 10.

The method further includes the step of forming a second member 16 or 16'. The second member 16 or 16' has an outer periphery. The second member 16 or 16' is sized and configured to be received within the at least one channel 32 or in the channels 68, 70 and 72 and will span across the three-dimensional bubble 22 or 22' when the securement mechanism 12 or 12' is in a closed position. The second member 16 or 16' has a first end 54 or 54' and one or more hook holes 56 or 56' formed therein. A pair hook holes 56, 56 is shown in FIG. 5 and a pair of hook holes 56', 56' is shown in FIG. 13. Each of the hook holes 56, 56 or 56', 56' is aligned with one of the hook holes 34, 34 or 34', 34' formed in the first member 14 or 14' when the second member 16 or 16' is retained within the at least one channel 32 or in the channels 68, 70 and 72. The second member 16 or 16' also has one or more notches 58 or 58' formed therein. A pair of notches 58, 58 is shown in FIG. 5 and a pair of notches 58', 58' is shown in FIG. 13. Each of the notches 58, 58 or 58', 58' extends to the outer periphery of the second member 16 or 16'. In addition, each of the notches 58, 58 or 58', 58' surround one of the first attachment members 36 or 36' when the second member 16 or 16 is received in the at least one channel 32 or the channels 68, 70 and 72.

The method still further includes inserting a product 24 into the three-dimensional bubble 22 or 22.

Still further, the method includes sliding the second member 16 or 16' into the at least one channel 32 or the channels 68, 70 and 72 of the first member 14 or 14' when the securement mechanism 12 or 12' is in an open position. The second member 16 or 16' retains the product 24 in the three-dimensional bubble 22 or 22'.

The method further includes the step of folding the tab 38 or 38' at the hinge 40 or 40' whereby each of the second attachment members 48, 48 or 48', 48' will be able to pass through the notches 58, 58 or 58', 58' and engage with one of the first attachment members 36, 36 or 36', 36'. In so doing, the second member 16 or 16' will be held secure in a set position relative to the first member 14 or 14'. The second member 16 or 16' is retained within the at least one channel 32 or the channels 68, 70 and 72 when the securement mechanism 12 or 12' is in a closed position. If desired, the first attachment members 36, 36 or 36', 36' can be bonded by glue or adhesive or welded, such as by thermal-welding, to form a secure attachment. When a secure bond or weld is formed, the second member 16 or 16' can only be separated from the first member 14 or 14' once as the land areas 53 of the perforation line 47 or 47' are broken. When this occurs, the bounded area (A) or (A') is physically separated from the first member 14 or 14' and a visual indication is provided that the blister package 10 or 10' has been opened. To reseal the blister package 10 or 10', it has to be returned to the manufacture.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A blister package having a securement mechanism, comprising:

a) a first bubble member having a front surface, a back surface and a three-dimensional bubble formed between said front and back surfaces which is capable of at least partially retaining a product, said first bubble member having a peripheral flange with a major portion and a minor portion, said major portion being folded upon itself to create at least one channel and said minor portion having a hook hole formed therethrough and having at least one area bounded by a perforation line which is capable of being broken to separate said at least one area from said first bubble member;

b) a securement mechanism integrally formed with said minor portion of said peripheral flange, said securement mechanism including a first attachment member formed on said minor portion of said peripheral flange, a tab extending outwardly from said minor portion and having a hinge formed therein, said perforation line extending from a first side of said hinge around said first attachment member to a second side of said hinge, and a second attachment member formed in said tab outward of said hinge, said second attachment member being sized to cooperate with said first attachment member when said tab is pivoted about said hinge to close said blister package; and c) a second slideable member having an outer periphery and being sized and configured to be slideably received within said at least one channel when said securement mechanism is in an open position, said second slideable member having a notch formed therein which extends to said outer periphery, said notch partially surrounding said first attachment member when said second slideable member is received in said at least one channel, said second slideable member being retained within said at least one channel when said securement mechanism is in a closed position, and said second slideable member capable of being removed from said first bubble member when said perforation line is broken and said at least one area is separated from said first bubble member.

2. The blister package of claim 1 wherein said first bubble member is thermoformed, said first attachment member extends outward from said back surface in the same direction as said three-dimensional bubble, and said perforation line includes a plurality of land areas separated by slots and said land areas can be physically broken to permit said at least one area to be physically separated from said first bubble member.

3. The blister package of claim 2 wherein said first attachment member is thermally welded to said second attachment member which allows said blister package to be opened only once.

4. The blister package of claim 2 wherein said first attachment member is glued to said second attachment member which allows said blister package to be opened only once.

5. The blister package of claim 1 wherein said first attachment member has a square cross-sectional configuration, said second attachment member has a circular cross-sectional configuration which extends outward from said front surface in an opposite direction to said first attachment member, said circular cross-sectional configuration is sized to engage with said square cross-sectional configuration to form an interference fit therewith and close said blister package, and said first attachment member is permanently bonded to said second attachment member.

6. The blister package of claim 1 wherein said major portion of said peripheral flange extends at least about 70% around said first bubble member and said first attachment member is thermally welded to said second attachment member.

7. The blister package of claim 6 wherein said tab has a width, said hinge is a living hinge formed from two spaced apart semi-circular members, and each semi-circular member extends completely across said width.

8. The blister package of claim 1 wherein said first bubble member has a longitudinal central axis, a pair of first attachment members is present with each projecting inward from said back surface, each of said pair of first attachment members being located on opposite sides of said longitudinal central axis, and a pair of second attachment members is present with each extending outward from said front surface and in an opposite direction to said pair of first attachment members, and each of said pair of second attachment members is located on opposite sides of said longitudinal central axis.

9. The blister package of claim 1 wherein said second slideable member has a longitudinal central axis, a pair of hook holes is formed through said second slideable member with each hook hole located on an opposite side of said longitudinal central axis, and a pair of notches is formed through said second slideable member with each of said notches extending to said outer periphery of said second slideable member, and each of said notches being aligned adjacent to one of said hook holes.

10. A blister package having a securement mechanism, comprising:

a) a first transparent member having a front surface, a back surface and a three-dimensional bubble formed between said front and back surfaces which is capable of at least partially retaining a product, said first transparent member having a peripheral flange with a major portion and a minor portion, said major portion being folded upon itself to create at least two oppositely aligned channels, said minor portion being aligned at an angle to said at least two channels and having a pair of hook holes formed therethrough, and having at least one area bounded by a perforation line which is capable of being broken to separate said at least one area from said first transparent member;

b) a securement mechanism integrally formed with said minor portion of said peripheral flange, said securement mechanism including a first attachment member formed on said minor portion of said peripheral flange, a tab extending outwardly from said minor portion of said peripheral flange and having a hinge formed therein, and a second attachment member formed in said tab outward of said hinge, said second attachment member being sized to cooperate with said first attachment member when said tab is pivoted about said hinge to close said blister package; and c) a second slideable member having an outer periphery and being sized and configured to be slideably received within said two channels when said securement mechanism is in an open position, said second slideable member having a notch formed therein which extends to said outer periphery and partially surrounds said first attachment member when said second slideable member is received in said at least two channels, said second slideable member being retained within said at least two channels when said securement mechanism is in a closed position, and said second slideable member capable of being removed from said first transparent member when said perforation line is broken and said at least one area is separated from said first transparent member.

11. The blister package of claim 10 wherein said hinge is a living hinge and said first attachment member is permanently bonded to said second attachment member.

12. The blister package of claim 11 wherein said major portion of said peripheral flange extends around at least about 75% of said first transparent member, and said minor portion of said peripheral flange extends around at least about 15% of said first transparent member.

13. The blister package of claim 11 wherein said second slideable member has an approximately rectangular configuration with first and second sides and first and second ends, and said major portion of said peripheral flange is folded upon itself at said first and second sides and at said second end to create first, second and third channels.

14. The blister package of claim 13 wherein said minor portion of said peripheral flange is located adjacent to said first end of said second slideable member and said minor portion is not folded.

15. The blister package of claim 13 wherein said first, second and third channels are spaced apart from one another.

16. A blister package having a securement mechanism, comprising:

a) a first thermoformed member having an approximately rectangular configuration with first and second sides and first and second ends, said first thermoformed member having a front surface, a back surface and a three-dimensional bubble formed between said front and back surfaces which is capable of at least partially retaining a product, said first thermoformed member having a peripheral flange extending outward from said first and second sides and from said first and second ends, said peripheral flange being folded upon itself at said first and second sides and at said second end to create first, second and third channels, said peripheral flange adjacent to said first end having a hook hole formed therethrough and having at least one area bounded by a perforation line which is capable of being broken to separate said at least one area from said first thermoformed member;

b) a securement mechanism integrally formed with said peripheral flange adjacent to said first end which permits said blister package to be closed, said securement mechanism including a first attachment member formed on said peripheral flange adjacent to said first end, a tab extending outwardly from said peripheral flange adjacent to said first end and having a hinge formed therein, and a second attachment member formed in said tab outward of said hinge, said second attachment member being sized to cooperate with said first attachment member when said tab is pivoted about said hinge to close said blister package; and c) a second slideable member having an outer periphery and being sized and configured to be slideably received within said first, second and third channels when said securement mechanism is in an open position, said second slideable member having a notch formed therein which extends to said outer periphery and partially surrounds said first attachment member when said second slideable member is received in said first, second and third channels, said second slideable member being retained within said first, second and third channels when said securement mechanism is in a closed position, and said second slideable member capable of being removed from said first thermoformed member when said perforation line is broken and said at least one area is separated from said first thermoformed member.

17. The blister package of claim 16 wherein said second slideable member has an approximately rectangular configuration with a first end, a front surface and an oppositely aligned back surface, said second slideable member is formed from paperboard and at least one of said front and back surfaces is capable of being printed, and said second slideable member has at least one hook hole formed therethrough adjacent to said first end which is aligned with said hook hole formed in said first thermoformed member when said second slideable member is retained within said first, second and third channels and said securement mechanism is in a closed position.

18. The blister package of claim 17 wherein each side of said second slideable member is surrounded by one of said first, second and third channels and by said securement mechanism.

19. The blister package of claim 16 wherein said hinge is a living hinge which includes a pair of semi-circular shaped members aligned parallel to and spaced apart from one another.

20. The blister package of claim 16 wherein an audible sound is generated when said second attachment member engages with said first attachment member as said securement mechanism is moved to a closed position.

21. A method of forming a blister package having a securement mechanism, said method comprising the steps of:

a) forming a first bubble member from a transparent sheet of plastic material, said first bubble member having a front surface, a back surface, and a three-dimensional bubble surrounded by a peripheral flange having a major portion and a minor portion, said minor portion having at least one area bounded by a perforation line which is capable of being broken to separate said at least one area from said first bubble member, said bubble being formed between said front and back surfaces and being capable of at least partially retaining a product, and integrally forming a securement mechanism on said minor portion of said peripheral flange, said securement mechanism including a first attachment member formed on said minor portion of said peripheral flange, a tab extending outwardly from said minor portion of said peripheral flange and having a hinge formed therein, and a second attachment member formed in said tab outward of said hinge, said second attachment member being sized to cooperate with said first attachment member when said tab is folded about said hinge to close said blister package;

b) forming a hook hole in said minor portion of said peripheral flange;

c) folding said major portion of said peripheral flange upon itself to create at least one channel; and d) forming a second slideable member having an outer periphery, said second slideable member being sized and configured to be received within said at least one channel and which spans across said three-dimensional bubble when said securement mechanism is in a closed position, said second slideable member having a first end and having a hook hole formed therein which is aligned with said hook hole formed in said first bubble member when said second slideable member is retained within said at least one channel, said second slideable member having a notch formed therein which extends to said outer periphery and partially surrounds said first attachment member when said second slideable member is received in said at least one channel, and said second slideable member is retained within said at least one channel when said securement mechanism is in a closed position.

22. A method of forming a blister package having a securement mechanism and then inserting a product therein, said method comprising the steps of:

a) forming a first bubble member from a transparent sheet of plastic material, said first bubble member having a front surface, a back surface, and a three-dimensional bubble surrounded by a peripheral flange having a major portion and a minor portion, said minor portion having at least one area bounded by a perforation line which is capable of being broken to separate said at least one area from said first bubble member, said bubble being formed between said front and back surfaces and being capable of at least partially retaining a product, and integrally forming a securement mechanism on said minor portion of said peripheral flange, said securement mechanism including a pair of first attachment members formed on said minor portion of said peripheral flange, a tab extending outwardly from said minor portion of said peripheral flange and having a hinge formed therein, and a pair of second attachment members formed in said tab outward of said hinge, said pair of second attachment members being sized to cooperate with said pair of first attachment members when said tab is folded about said hinge to close said blister package;

b) forming a pair of hook holes in said minor portion of said peripheral flange;

c) folding said major portion of said peripheral flange upon itself to create at least one channel;

d) forming a second slideable member having an outer periphery, said second slideable member being sized and configured to be received within said at least one channel and which spans across said three-dimensional bubble when said securement mechanism is in a closed position, said second slideable member having a first end and having a pair of hook holes formed therein each of which is aligned with one of said hook holes formed in said first bubble member when said second slideable member is retained within said at least one channel, said second slideable member having a pair of notches formed therein each of which extends to said outer periphery and each of which partially surrounds one of said first attachment members when said second slideable member is received in said at least one channel, and said second slideable member is retained within said at least one channel when said securement mechanism is in a closed position;

e) inserting a product into said three-dimensional bubble;

f) sliding said second slideable member into said at least one channel of said first bubble member when said securement mechanism is in an open position, said second slideable member retaining said product in said three-dimensional bubble; and g) folding said tab at said hinge whereby said second attachment members pass through said pair of notches and engage with said pair of first attachment members to close said blister package.

* * * * *